United States Patent [19]

Crankshaw

[11] 4,124,429

[45] Nov. 7, 1978

[54] LABEL APPLICATOR WITH BELT TRANSPORT

[75] Inventor: Michael Crankshaw, Santa Fe Springs, Calif.

[73] Assignee: Label-Aire Inc., Fullerton, Calif.

[21] Appl. No.: 820,205

[22] Filed: Jul. 29, 1977

[51] Int. Cl.[2] ..... B65C 9/18; B65C 9/34

[52] U.S. Cl. ..... 156/364; 156/449; 156/542; 156/584; 156/DIG. 13; 156/DIG. 33; 156/DIG. 41

[58] Field of Search ..... 156/540, 541, 542, DIG. 33, 156/DIG. 31, 41, 13, 11, 351, 5, 584, 344, 449, 450, 455, 566, 570, 571, 572, 235, 238, 363, 364, 361; 221/73, 74; 271/10, 98, 94, 97, 12

[56] References Cited

U.S. PATENT DOCUMENTS

| | | | |
|---|---|---|---|
| Re. 23,512 | 6/1952 | Von Hofe | 156/DIG. 13 |
| 3,556,898 | 1/1971 | Allen | 156/541 |
| 3,713,948 | 1/1973 | Klugen | 156/351 |
| 3,779,829 | 12/1973 | Wolff | 156/DIG. 12 |
| 3,850,774 | 11/1974 | Schönig et al. | 156/542 |
| 3,984,277 | 10/1976 | French et al. | 156/541 |

*Primary Examiner*—Douglas J. Drummond
*Assistant Examiner*—M. Ball
*Attorney, Agent, or Firm*—Gordon L. Peterson

[57] ABSTRACT

A label applicator including a wrap around label applicator, a transport for transporting labels to the wrap around label applicator, and a label dispenser for sequentially supplying labels to the transport.

10 Claims, 6 Drawing Figures

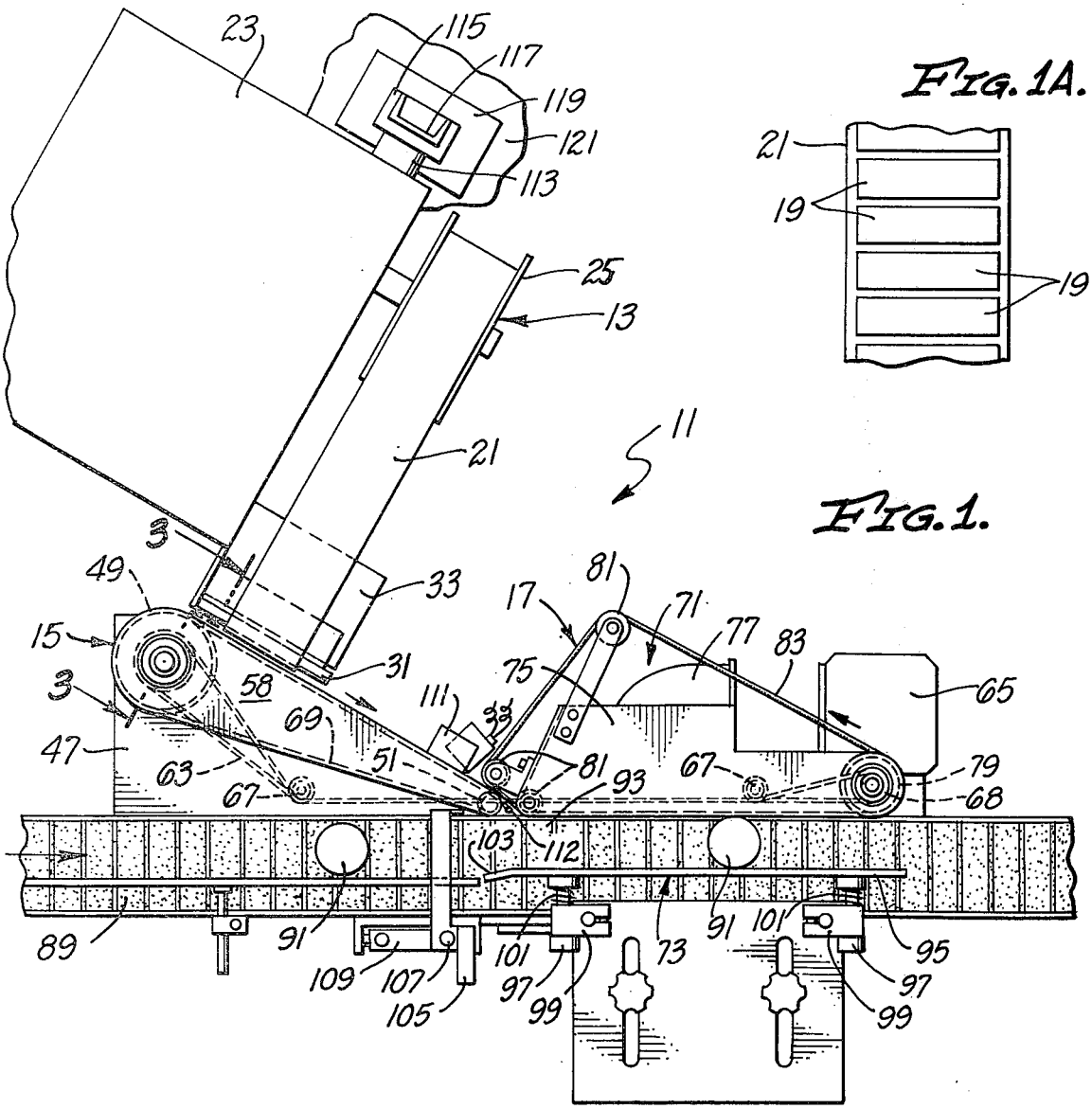
FIG. 1A.
FIG. 1.
FIG. 2.
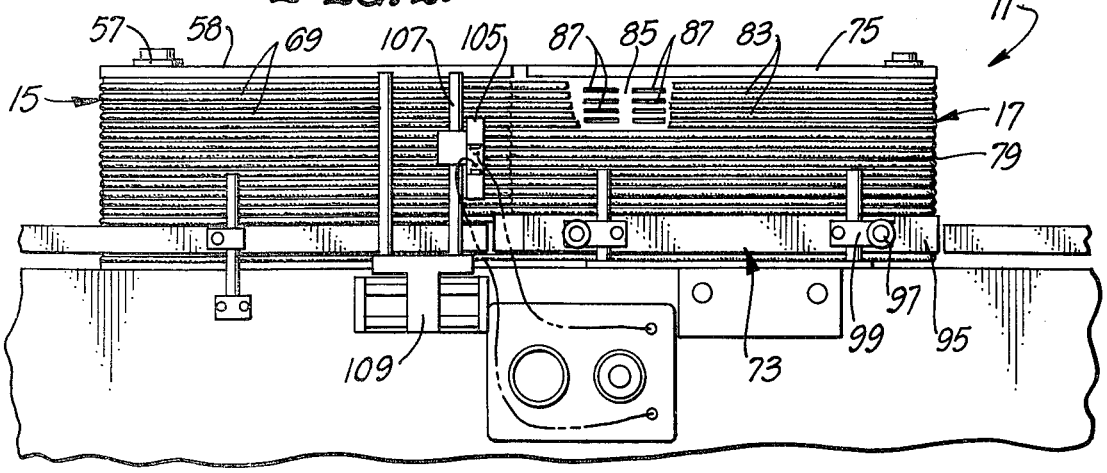

LABEL APPLICATOR WITH BELT TRANSPORT

BACKGROUND OF THE INVENTION

Wrap around label application typically involves wrapping a label around, or part way around, the peripheral wall of an article. In order to wrap the label around the article, the article is ususally rotated during label application.

Labels are usually provided by adhesively attaching them to an elongated backing strip. The labels are sequentially removed by moving the backing strip over a peeling bar. The labels are releasably retained on a grid adjacent the peeling bar by applying subatmospheric pressure to one side of the grid.

For wrap around label application, the grid releasably retains the removed label adjacent the wrap around belt. The article to be labeled is moved by a conveyor into contact with the label at a labeling station and the article is rotated as it moves through the labeling station to wrap the label around the article. This is shown in U.S. Pat. No. 3,984,277.

Although label applicators of the wrap around type perform generally satisfactorily, the label application rate is not as high as when using conventional label application techniques.

SUMMARY OF THE INVENTION

One important purpose of this invention is to increase the speed of certain label application operations, such as wrap around label applicating. In wrap around labeling, a new label cannot be peeled off of the backing strip until the article being labeled passes through the labeling station. If the new label is dispensed before this time, it may be forced against the article being labeled, in which event, the article would receive two labels. Consequently, the label application rates are reduced.

This invention substantially reduces the interval between successive label dispensing operations and permits labels to be dispensed at a much higher rate than was possible heretofore with conventional wrap around labeling techniques. With this invention, the label dispensing function is physically separated from the wrap around labeling function. Consequently, the label dispenser is not slowed down by the presence of articles at the labeling station. Labels are transferred from the label dispenser to the wrap around label applicator by a label transport or conveyor.

When the labels are provided on a backing strip, the slowest part of the label application function is the removal of the labels from the backing strip. In some instances, the labels to be applied are elongated and in this event, it is common practice to have the longitudinal axis of the label extend longitudinally of the backing strip. The present invention further increases labeling speed by utilizing labels having longitudinal axes which extend transversely of the backing strip to which they are adhered. With this arrangement, a label can be peeled off the backing strip by moving the backing strip a distance approximately equal to the relatively short dimension of the label. Previously, it had been necessary to move the backing strip for a distance about equal to the long dimension of the label. For example, a 3 inch by 1 inch rectangular label can be dispensed about three times as fast using the label orientation of this invention.

When labels having longitudinal axes extending transverse of the backing strip are used in wrap around labeling, it is necessary to move the backing strip across the peeling bar in a direction generally transverse to the direction of movement of the transport. This places the label on the transport with the longitudinal axis of the label extending generally in the direction of movement of the transport, i.e. toward the wrap around label applicator.

When a conventional label arrangement is used, it is necessary that the backing strip move over the peeling bar in a direction generally parallel to the direction of movement of the transport. To permit the label applicator of this invention to be used for both kinds of labels, the label applicator includes mounting means for mounting the label dispenser for pivotal movement relative to the transport.

It is known to move labels with a vacuum transport belt as shown, for example, in common assignee's allowed application Ser. No. 664,966 filed Mar. 8, 1976. To eliminate the need for an apparatus to create vacuum pressure for the transport, this invention provides for using the adhesive on the face of the label to releasably retain the label on the transport when the label is being transported to the wrap around label applicator.

The label removed from the backing strip can be applied directly to the transport or releasably retained. For example, the removed label can be retained by a vacuum box and transferred to the transport at an appropriate instant by means of an air blast, tamping, etc.

With this invention, articles to be labeled are conveyed through a labeling station by an article conveyor and an article sensor provides a signal indicating when an article to be labeled approaches the labeling station. This signal is used to cause transfer of the label from the retaining means to the transport.

The wrap around label applicator includes a wrap around vacuum transport which receives labels from the label transport. Although these two transports can run at different speeds, transfer of the labels from one transport to the other is facilitated if they run at synchronous speeds. This speed is preferably greater than the speed at which the article conveyor moves. The vacuum transport can move the label at the labeling station so that it can catch up with the article to be labeled.

The invention, together with further features and advantages thereof, may best be understood by reference to the following description taken in connection with the accompanying illustrative drawing.

BRIEF DESCRIPTION OF THE DRAWING

FIG. 1 is a plan view of a label applicator constructed in accordance with the teachings of this invention.

FIG. 1A is a fragmentary plan view of a strip of labels for use with the label applicator when it is in the position of FIGS. 1-3.

FIG. 2 is a fragmentary front elevational view of the label applicator.

DESCRIPTION OF THE PREFERRED EMBODIMENT

Figure 3:
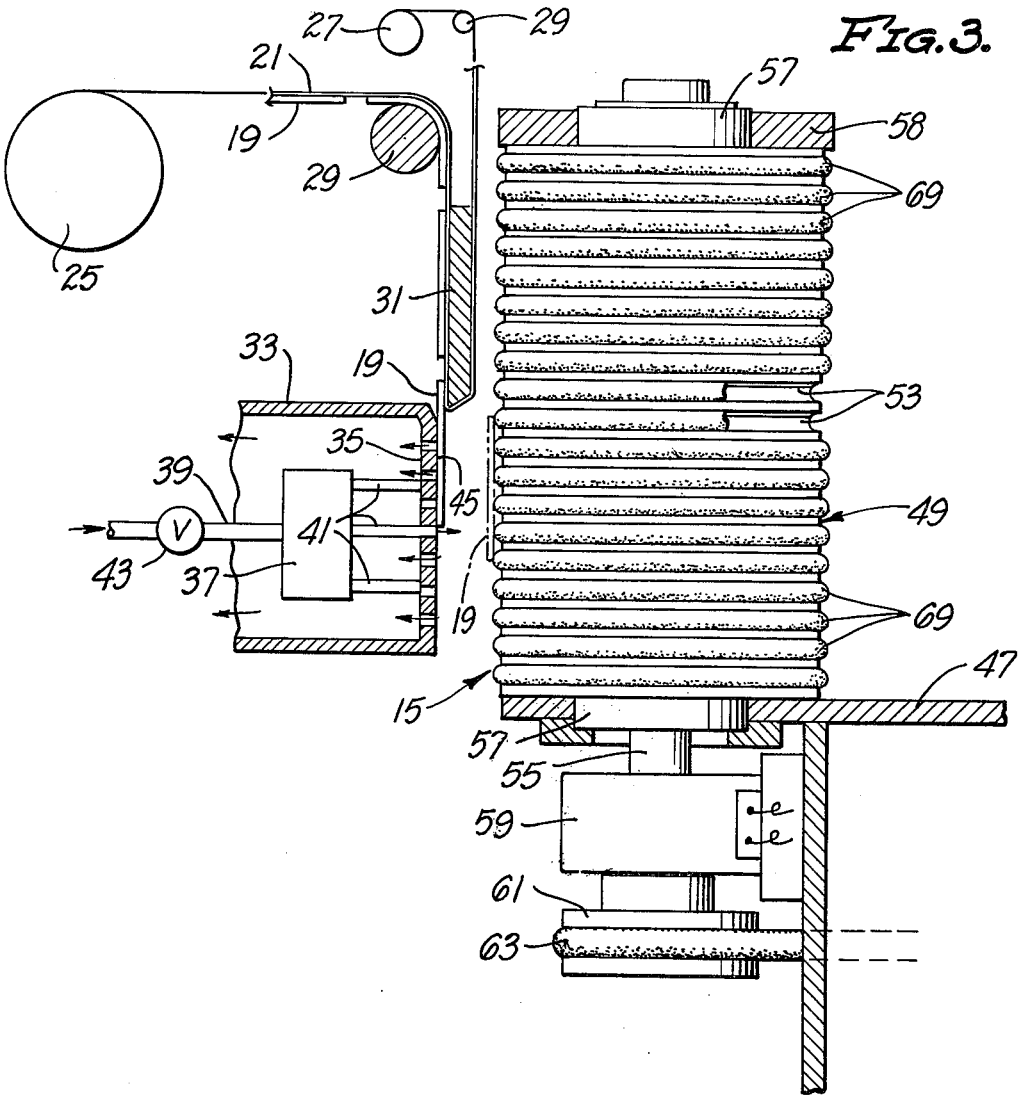
FIG. 3 is a sectional view taken generally along line 3—3 of FIG. 1 showing the dispensing means is one angular position relative to the label transport.

FIG. 1 shows a label applicator 11 which generally includes a label dispenser 13, a label conveyor or transport 15, and a wrap around label applicator 17. The label dispenser 13 may be of conventional construction, and in the embodiment illustrated, it may be of the type shown and described in common assignee's U.S. Pat. No. 3,729,362. Because the label dispenser 13 may be of conventional construction, it is not described in detail herein.

The label dispenser 13 is adapted to dispense labels 19 (FIG. 1A) which are adhesively mounted on an elongated backing strip 21. As shown in FIG. 1A, each of the labels 19 is generally rectangular and has a longitudinal axis which extends perpendicular to the longitudinal axis of the backing strip 21. Although the label dispenser 13 is of the type which dispenses labels 19 from the backing strip 21, it should be understood that the present invention is applicable to label dispensers of various different constructions and can be used with labels which are not pressure sensitive.

Briefly, the label dispenser 13 includes a supporting structure 23 having a supply reel 25 (shown diagrammatically in FIG. 3) and a take-up reel 27 rotatably mounted thereon. The backing strip 21 is wound on the reels 25 and 27 and extends over various guide rollers, including the guide rollers 29 (FIG. 3) and a peeling bar 31. The labels 19 can be removed from the peeling bar 31 at a label removal station by pulling the backing strip 21 over the peeling bar in a well-known manner. With the labels 19 arranged as shown in FIG. 1A, a label is completely peeled off of the backing strip 21 in response to movement of the backing strip over the peeling bar a distance equal to approximately the short dimension of the label.

The label dispenser 13 also includes means for releasably retaining the removed labels 19. Although this means can take various different forms, in the embodiment illustrated, it includes a vacuum box 33, one wall of which forms an air pervious grid 35. By reducing the interior of the vacuum box 33 to a subatmospheric pressure, the removed labels 19 are releasably retained on the outer face of the grid.

Movement of the backing strip 21 over the peeling bar 31 is in a direction transverse to the direction of movement of the transport 15. Thus, the label 19 is placed on the grid 35 with the long dimension of the label extending parallel to the direction of movement of the transport 15.

The label dispenser 13 also includes means for transferring the removed label 19 from the grid 35 to the label transport 15. Although the transferring means may take different forms, in the embodiment illustrated, it includes a manifold 37 with the vacuum box 33 connected via a conduit 39 to a source of relatively high air pressure (not shown). A plurality of tubes 41 extend from the manifold 37 to selected openings in the grid 35. Accordingly, by appropriately operating a control valve 43 in the conduit 39, a blast of air can be selectively directed at the label 19 on the grid 35 to transfer the label to the transport 15.

The label 19 transferred to the transport 15 has its longitudinal axis extending generally in the same direction that the transport moves in transporting that label to the wrap around label applicator 17. In addition, the label 19 is retained on the grid 35 with the adhesive face 45 thereof facing outwardly of the grid. Accordingly, when the label 19 is transferred from the grid 35, the adhesive face 45 engages the transport and releasably adhesively attaches the label to the transport.

The primary function of the transport 15 is to transport the label 19 from a location adjacent the label dispenser 13 to the wrap around label applicator 17. Although the transport 15 could be a vacuum belt transport, the vacuum apparatus can be eliminated if desired because the adhesive on the adhesive face 45 is used to releasably attach the label to the transport.

In the embodiment illustrated, the transport 15 includes a mounting plate 47 (FIG. 3) on which a drive roller 49 and a driver or idler roller 51 are rotatably mounted. The roller 49 is of larger diameter than the roller 51, but otherwise these two rollers may be identical. As best seen in FIG. 3, the roller 49 includes a plurality of annular grooves 53 in the peripheral surface thereof, and corresponding grooves are provided in the forward roller 51.

The drive roller 49 is mounted on a shaft 55 (FIG. 3) which is in turn rotatably mounted on bearings 57 on the mounting plate 47 and on a top plate 58. The driver roller 51 is similarly mounted, and the top plate extends between the rollers 49 and 51. The shaft 55 is driven through a conventional, electrically operated clutch and brake 59 by a pulley 61 and a belt 63.

Although the drive roller 49 can be driven in various different ways, in the embodiment illustrated, this is accomplished by a motor 65 (FIG. 1) which suitably drives the belt 63. As shown in FIG. 1, the belt 63 is endless and extends around suitably mounted idlers 67 and drive pulley 68 driven by the motor 65. The drive roller 49 drives the driven roller 51 via a plurality of endless belts 69 which are seated in the grooves 53, respectively, and the corresponding grooves of the driven roller 51.

Although the wrap around label applicator 17 could be of various different constructions, in the embodiment illustrated, it includes a vacuum belt transport 71 which may be of known construction and a bar assembly 73 (FIGS. 1 and 2). The vacuum belt transport 71 includes a housing 75, a fan 77 for reducing the pressure in the housing to subatmospheric, a drive roller 79, a plurality of idler rollers 81, and a plurality of belts 83. The rollers 79 and 81 have annular grooves similar to the annular grooves 53 of the drive roller 49 (FIG. 3) to properly support the belts 83. The housing 75 has a front wall 85 (FIG. 2) with a plurality of slots 87 (FIG. 2) adjacent the drive roller 79 and generally between adjacent belts 83. The motor 65 drives the drive roller 79 and the drive roller 79 drives the idler rollers 81 by means of the belts 83. Preferably, the speed of the belts 69 and 83 are identical.

The label applicator 11 is adapted for use with an article conveyor, such as a conveyor 89 (FIG. 1) which is adapted to convey articles 91 through a labeling station 93 in the direction of the arrow in FIG. 1. By way of example, in the embodiment illustrated, the articles 91 are each in the form of a cylindrical can. One of the articles 91 shown in FIG. 1 has been labeled and another of the articles is approaching the labeling station 93. The bar assembly 73 guides the articles 91 against the belts 83 and because of the friction between the belts 83 and the article and because the belts 83 are moving faster than the conveyor 89, the article 91 is caused to rotate. In the embodiment illustrated, the bar assembly 73 includes a bar 95 mounted on a pair of shafts 97 which are in turn mounted for sliding movement in mounting blocks 99, respectively. Springs 101 bear against the mounting blocks 99 to resiliently urge the bar 95 toward the vacuum belt transport 71. The upstream end of the bar 95 is inclined away from the vacuum belt transport 71 to form a tapered lead-in surface 103.

An article sensor 105 (FIGS. 1 and 2), which may be in the form of a photocell, is mounted on a vertical shaft 107 which is in turn carried by a carriage 109 suitably mounted on the supporting structure for the label applicator 11. The article sensor 105 senses the presence of one of the articles 91 in a conventional manner as it moves past the sensor. Similarly, a label sensor 111 (FIG. 1) senses the presence of a label 19 on the transport 15 adjacent the vacuum belt transport 71 and shuts down the label applicator 11 if no label appears adjacent the sensor 111 at the appropriate instant.

The label applicator 11 can be controlled in various different ways, and the method of control and operation described below is purely illustrative. For example, at the beginning of a cycle, it may be assumed that the label 19 is releasably retained on the grid 35 (FIG. 3), that movement of the backing strip 21 across the peeling bar 31 is arrested, that the clutch and brake 59 hold the drive roller 49 stationary and that the belts 83 of the vacuum belt transport 71 run continuously.

When one of the articles 91 passes in front of the article sensor 105, the sensor detects that article and opens the valve 43 whereupon a jet of air transfers the label 19 from the grid 35 to the belts 69 with the adhesive face 45 of the label contacting the belts. The opening of the valve 43 to transfer the label 19 from the grid 35 can be brought out in the same manner as in a conventional labeling operation. Simultaneously, or after a predetermined short delay, the brake of the clutch and brake 59 is released and the clutch thereof is engaged to permit the motor 65 to drive the belts 69 at the same speed as the belts 83. This causes the label which is adhered to the belt 69 to be transported, preferably at a greater rate of speed than the article 91, toward the labeling station 93.

When the label 19 being transported by the belt 69 reaches the labeling station 93, it is peeled off of the belts 69 in any suitable manner such as by an air blast from a nozzle 112. The belts 69 are spaced apart so that the air under pressure from the nozzle 112 can act directly on the label 19 to peel it from the belts 69 and transfer it to the belts 83. The vacuum pressure acting through the slots 87 attracts the label and holds the label against the belts 83 so that the vacuum belt transport 71 can move the label to the right as viewed in FIG. 1. The label arrives at the labeling station 93 just after the article 91, and the adhesive side of the label is facing toward the article. However, because the belts 83 travel faster than the conveyor 89, the label catches up with the article. The resiliently biased bar 95 urges the article 91 against the belts 83 and the label 19 at the labeling station 93 to cause the article to rotate through the labeling station to consequently wrap the label around the article.

One advantage of the present invention is that immediately following the transfer of the label 19 from the grid 35 to the belt 69, the label dispenser 13 is capable of removing a second of the labels 19 from the backing strip 21 and supplying it to the grid 35. If the articles 91 are coming in rapid succession, the second label 19 may be immediately transferred to the grid 35, and there is no need to wait from the application of the first label to the first of the articles 91. Thus, the label applicator 11 can operate just as fast as labels can be removed from the backing strip 21. After the belts 69 have traveled a sufficient distance to transfer the label to the labeling station 93, the clutch and brake 59 may be automatically operated to stop the rollers 49 and 51. Alternatively, these rollers may be operated continuously.

Figure 4:
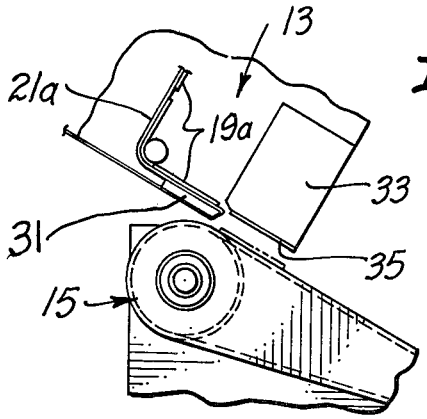
FIG. 4 is a fragmentary plan view showing the dispensing means in a second angular position relative to the label transport.
Figure 4A:
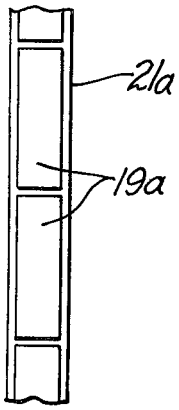
FIG. 4A is a fragmentary plan view of a strip of labels for use with the label applicator when it is in the position of FIG. 4.

The label applicator 11 is also adapted to apply labels **19*a* of the type shown in FIG. 4A wherein the longitudinal axis of the label extends longitudinally of the backing strip 21*a*. This is accomplished by mounting the label dispenser 13 for pivotal movement so as to rotate the label dispenser 90° with respect to the transport 15. This enables the labels 19*a* to be moved across the peeling bar 31 (FIG. 4) in a direction parallel to the direction of movement of the portion of the transport 15 which moves the label 19*a* to the wrap around label applicator 17. In all other respects, the label applicator 11 works in the same manner as described above with reference to FIGS. 1–3**.

Although the pivoting of the label dispenser 13 can be carried out in different ways, in the embodiment illustrated, the supporting structure 23 is mounted on a stub shaft 113 (FIG. 1) carried by a slide 115 which is mounted for vertical sliding movement along a supporting post 117. The label dispenser 13 can be locked in any one of a plurality of angular positions about the stub shaft 113 using known techniques and the slide 115 can be locked in any of a plurality of spaced vertical positions on the post 117 also using known techniques. The post 117 is in turn mounted on a base 119 which is mounted on a horizontally movable platform 121. Accordingly, by pivoting the label dispenser 13 through 90° from the position shown in FIG. 1 to the position shown in FIG. 4, and by adjusting the vertical position of the slide 115 on the post 117 and by moving the platform 121 horizontally, the label dispenser 13 can be brought into the position shown in FIG. 4.

Although this invention has been described with reference to wrap around label application, its use is not limited thereto. The invention is applicable to any kind of label application, and it is particularly applicable to label application techniques in which the application of a label delays the dispensing of the next label to be applied.

Although an exemplary embodiment of the invention has been shown and described, many changes, modifications and substitutions may be made by one having ordinary skill in the art without necessarily departing from the spirit and scope of this invention.

I claim:

1. A label applicator for applying labels to articles wherein the labels are provided on an elongated backing strip and the articles are conveyed through a labeling station, said label applicator comprising:

means for moving the backing strip with the labels thereon longitudinally of the backing strip through a label removal station;

means at the label removal station for peeling at least one of the labels from the backing strip;

retaining means at the label removal station for receiving and releasably retaining said one label when said one label is at least partially removed from the backing strip;

a transport having movable means for moving labels in a first direction from a first location to a second location;

first means responsive to at least one of the articles being in a predetermined position for transferring said one removed label from said retaining means to the transport at the first location;

a wrap around label applicator;

means for transferring said one label from the transport at the second location to said wrap around label applicator; and said wrap around label applicator including means for wrapping said one label at least part way around said one article.

2. A label applicator as defined in claim 1 including mounting means for mounting said moving means, said peeling means, and said retaining means for pivotal movement relative to said transport.

3. A label applicator as defined in claim 1 wherein each of the labels has a pressure sensitive adhesive on at least one face thereof, said peeling means is responsive to movement of the backing strip by the moving means to remove said one label from the backing strip, said first means transfers said one label from the retaining means to the transport so that the adhesive face of said one label engages the movable means of the transport to releasably retain said one label on said movable means as said one label is moved from said first location to said second location.

4. A label applicator for applying labels to articles wherein the labels are provided on an elongated backing strip and the articles are conveyed through a labeling station, said label applicator comprising:

means for moving the backing strip with the labels thereon longitudinally of the backing strip through a label removal station;

a peeling bar at the label removal station and having a peeling surface over which the backing strip can be drawn by said moving means for peeling at least one of the labels from the backing strip;

retaining means at the label removal station for receiving and releasably retaining said one label at the label removal station when said one label is at least partially removed from the backing strip;

a wrap around label applicator;

a transport having movable means for moving labels in a first direction from a first location to the wrap around label applicator;

said peeling surface extending generally in said first direction whereby said moving means can draw the backing strip over the peeling bar in a direction generally transverse to said first direction;

first means for transferring said one removed label from said retaining means to the transport at the first location; and said wrap around label applicator receiving said one label from said transport and including means for wrapping said one label at least part way around said one article.

5. A label applicator as defined in claim 4 wherein each of said labels has a pressure sensitive adhesive on at least one face thereof and said first means supplies labels to the transport so that the adhesive face engages the transport to retain such label on the transport as the label travels from said first location to said wrap around label applicator.

6. A label applicator as defined in claim 4 wherein said wrap around label applicator includes means for rotating an article and wrapping the label at least part way around the article as it rotates.

7. A label applicator as defined in claim 4 wherein said wrap around label applicator includes a vacuum belt transport for receiving the label from the transport and means cooperating with the vacuum belt transport for wrapping the label at least part way around the article.

8. A label applicator as defined in claim 7 wherein said vacuum belt transport includes first and second rollers and an endless belt extending around said rollers, the region of the endless belt between said rollers on one side of said rollers being adapted to confront the article to be labeled, and said vacuum belt transport includes means for providing vacuum pressure at said region of said belt to hold labels on said region of said belt.

9. A label applicator as defined in claim 7 wherein each of said transport and said vacuum belt transport has movable means for moving labels and the labels are transferred from the transport to the vacuum belt transport, and the label applicator includes means for moving both of said movable means at approximately the same speed.

10. A label applicator as defined in claim 9 wherein the articles are moved past the wrap around label applicator at a first speed, and said means for moving the movable means moves both of said movable means at a speed greater than said first speed.

* * * * *